US009332798B2

(12) United States Patent
Gafforio et al.

(10) Patent No.: US 9,332,798 B2
(45) Date of Patent: May 10, 2016

(54) DEVICE FOR REGULATING AND FASTENING A STRAP OF PROTECTING HELMETS

(75) Inventors: Luca Gafforio, Comun Nuovo (IT); Alberto Salvetti, Bergamo (IT)

(73) Assignee: NOLANGROUP S.P.A., Brembate di Sopra (BG) (IT)

( * ) Notice: Subject to any disclaimer, the term of this patent is extended or adjusted under 35 U.S.C. 154(b) by 652 days.

(21) Appl. No.: 13/549,986

(22) Filed: Jul. 16, 2012

(65) Prior Publication Data

US 2013/0031702 A1 Feb. 7, 2013

(30) Foreign Application Priority Data

Aug. 3, 2011 (EP) ..... 11006380

(51) Int. Cl.

| | |
|---|---|
| ***A42B 3/08*** | (2006.01) |
| ***A42B 3/32*** | (2006.01) |
| ***A43C 11/14*** | (2006.01) |
| *A43C 11/12* | (2006.01) |

(52) U.S. Cl.

CPC . *A42B 3/08* (2013.01); *A42B 3/328* (2013.01); *A43C 11/146* (2013.01); *A43C 11/12* (2013.01); *Y10T 24/2192* (2015.01)

(58) Field of Classification Search

CPC ..... A42B 3/08; A42B 3/324; A42B 3/326; A42B 3/328; A43C 11/12; A43C 11/14; A43C 11/1406; A43C 11/146

USPC ..... 2/421; 24/68 E

See application file for complete search history.

(56) References Cited

U.S. PATENT DOCUMENTS

| | | | | | |
|---|---|---|---|---|---|
| 4,453,290 | A * | 6/1984 | Riedel | A43C 11/1406 | 24/68 SK |
| 4,761,898 | A * | 8/1988 | Courvoisier | A43C 11/1413 | 24/68 SK |
| 4,796,336 | A * | 1/1989 | Scully | A44B 11/125 | 24/196 |
| 4,843,688 | A * | 7/1989 | Ikeda | A44B 11/12 | 24/170 |
| 4,903,381 | A | 2/1990 | Fohl | | |
| 5,172,454 | A * | 12/1992 | Martignago | A43C 11/1406 | 24/68 SK |
| 5,416,952 | A * | 5/1995 | Dodge | A43C 11/00 | 24/68 A |
| 5,606,779 | A * | 3/1997 | Lu | A43C 11/146 | 24/68 SK |
| 5,779,259 | A * | 7/1998 | Lin | A43C 11/1413 | 24/68 SK |

(Continued)

FOREIGN PATENT DOCUMENTS

| | | |
|---|---|---|
| EP | 0 772 983 A1 | 5/1997 |
| EP | 0 820 707 A2 | 1/1998 |

(Continued)

*Primary Examiner* — Robert J Hicks
*Assistant Examiner* — Cameron A Carter
(74) *Attorney, Agent, or Firm* — Lucas & Mercanti, LLP.

(57) ABSTRACT

Disclosed is a device for fastening and adjusting a strap having a base body structured to allow insertion of part of the strap therein, and one ratchet constrained in a rotatable manner to the base body and provided with a coupling portion adapted to engage one corresponding portion of the strap. The device includes first elastic means interposed between the ratchet and the base body to reversibly retain the ratchet in one position of engagement with the strap, and one operating lever to rotate the ratchet from a position of engagement with the strap to a position of disengagement therefrom. The operating lever of the device is constrained on the ratchet in a rotatable manner for one given angular interval. The device also has second elastic means to regulate rotation of the operating lever relative to the ratchet in the angular interval of rotation.

17 Claims, 7 Drawing Sheets

(56) References Cited

U.S. PATENT DOCUMENTS 5,887,318 A * 3/1999 Nicoletti ..... A43C 11/1413 24/68 SK
5,909,850 A * 6/1999 Cavasin ..... A43C 11/1413 24/70 SK
5,974,633 A * 11/1999 Sartor ..... A43C 11/1406 24/68 SK
6,116,580 A * 9/2000 Hull ..... B66D 1/06 254/357
6,195,848 B1 * 3/2001 Jackson ..... B60P 7/083 24/68 CD
6,374,464 B1 * 4/2002 Lai ..... A43C 11/1406 24/68 SK
7,086,122 B2 * 8/2006 Livingston ..... A43C 11/1406 24/68 SK
7,246,383 B2 * 7/2007 Musal ..... A42B 3/145 2/418
7,966,701 B2 * 6/2011 Shiue ..... A61F 9/027 2/452
8,763,211 B1 * 7/2014 Yu ..... B60P 7/0823 24/191
2004/0040073 A1 * 3/2004 Morrow ..... A42B 3/08 2/424
2007/0089945 A1 * 4/2007 Martignago ..... A43C 11/146 188/79.54
2008/0134480 A1 * 6/2008 Shiue ..... A44B 11/20 24/68 E
2009/0151508 A1 * 6/2009 Signori ..... F16B 2/08 74/577 R
2011/0000057 A1 * 1/2011 Abdul ..... A43C 11/146 24/68 SK

FOREIGN PATENT DOCUMENTS

EP 1 159 885 A1 12/2001
EP 1 269 875 A2 1/2003
EP 2 272 390 A2 1/2011

* cited by examiner

DEVICE FOR REGULATING AND FASTENING A STRAP OF PROTECTING HELMETS

CROSS-REFERENCE TO RELATED APPLICATION

This application claims the benefit of priority from European Patent Application No. 11006380.7, filed Aug. 3, 2011, the contents of which are incorporated herein by reference.

FIELD OF THE INVENTION

The present invention relates to a device for adjusting and fastening a strap, and in particular for fastening and adjusting the chin strap, which allows the helmet to be secured to the user, preventing removal thereof.

BACKGROUND OF THE INVENTION

Safety helmets currently used in the field of motorcycling, and the like, are provided with a chin strap which is fastened and adjusted in length in such a manner as to adhere to the user's throat and thus prevent accidental removal of the helmet from the user's head, above all in the event of a fall.

In particular, the chin strap is generally constrained to one lower end of the helmet and fastened permanently to the other lower end of the helmet by means of a fastening device.

As a rule, the chin strap is formed of two or more parts, which can be mutually constrained and adjusted by means of the fastening device, which is integral with one end of these parts.

Although specific reference has been made to safety helmets used in the field of motorcycling, as will be seen, the device according to the present invention can be utilised in general on all safety helmets used to protect the head of a user, for example of two-wheeled vehicles and the like, snowmobiles, and even more generally to fasten and adjust any strap used to mutually secure two flaps of a garment or personal accessory.

Over the years, numerous systems have been developed to fasten and adjust the length of the chin strap of helmets, such as those that provide for insertion of at least one portion of the strap, usually ribbon-like, inside two rings.

Although being very simple to produce, this system is not very intuitive and is complicated to use, due to the need to pass the strap through the two rings according to a pre-established order, when wishing to fasten the chin strap.

Moreover, once the ribbon-like strap has been inserted through the two rings, its free end must be suitably secured, for example by means of Velcro portions, or similar means, to prevent an annoying flapping effect.

Also known are chin strap fastening systems comprising a buckle, inserted into which is a complementary portion, structured in such a manner as to reach a position of coupling therewith. Unfastening of the device is achieved through the operation of a button, which causes release of the complementary portion from the buckle. This type of device, which substantially comprises a male portion and a corresponding female portion movable between two positions, a coupling position and a release position of the chin strap, does not allow fine adjustment of the length of the strap to be performed in a simple and rapid manner.

In this regard, there have been developed devices for adjusting and fastening the chin strap, provided with a ratchet pivoted inside a related casing and having one or more teeth adapted to engage a corresponding toothed portion which is provided on the chin strap.

Engagement of the toothed portion of the ratchet with that of the strap allows this latter to be fastened inside the device in such a manner as to prevent extraction of the strap from the device without first operating the ratchet.

At the same time, these devices allow the length of the chin strap to be adjusted through sliding of the toothing of the strap inside the casing of the device in different positions of engagement with the ratchet until reaching the desired position. This type of adjustment is known in the art as "micrometric" coupling as it allows fine adjustment of the length of the chin strap which offers a high level of adaptability to the various users of these straps.

In this type of device, the ratchet is usually maintained in a position of engagement with the strap by means of a spring and when wishing to extract the strap from the fastening device to allow the user to remove the helmet from his or her head, he or she acts manually on the ratchet causing it to move away from the position of engagement with the toothed portion of the strap, and therefore allow it to be unfastened and slide freely.

These devices suffer from some drawbacks related to the fact that, in order to be operated manually, the ratchet must project from the body, or casing, of the device, and this can lead to accidental and undesirable shifting of the ratchet from the position in which the chin strap is fastened.

In particular, it is possible for the projecting part of the ratchet to be lifted through accidental contact with external objects, such as possible contact with parts of the motorcyclist's jacket, or movements of the user which can unintentionally cause unfastening of the strap.

To overcome these drawbacks, in some cases the dimensions of the ratchet are reduced in such a manner that it does not project and a tape is constrained thereto to facilitate operation of the ratchet by the user when he or she wishes to unfasten the chin strap.

In other devices, release of the ratchet from the fastened position of the chin strap is carried out through the operation of a further lever pivoted to the casing of the device and coupled kinematically to the ratchet. In these devices, the ratchet is moved from the position of engagement with the strap by acting on a lever, which is structured and placed in a position of contact with the ratchet in such a manner as to be able to cause unfastening thereof from the strap.

A device of this type is described in the document EP-A-0772983 by the applicant EDC, in which the ratchet is operated in rotation to disengage the chin strap by means of a lever constrained in a rotatable manner to the casing of the device.

It must be noted that, although being provided with a lever which prevents direct operation of the ratchet, in the device described in EP-A-0772983, the operating lever and the ratchet are always in contact, and this means that, to prevent accidental operation of the lever from causing unfastening of the strap, the lever must be shaped in such a manner as to have a surface of engagement with the ratchet with an initial rotation, albeit for a short angular interval, which has no effect on the ratchet.

Moreover, coupling between ratchet and lever, both pivoted to the casing of the device, must have a certain degree of precision, which entails compliance with somewhat limited tolerances.

This means that, both due to the particular shape of the lever, and due to the considerably limited tolerances required, the device described in EP-A-0772983 is complicated to produce and therefore costly.

Moreover, this fastening device of the chin strap is of noteworthy dimensions, due to the need to produce a body of the device with dimensions such as to be able to constrain thereon both the ratchet and the operating lever.

SUMMARY OF THE INVENTION

The object of the present invention is to provide a device for fastening and adjusting a strap, and in particular the chin strap of safety helmets, which solves the problems of prior art briefly described above.

In particular, an object of the present invention is to provide a device for fastening and adjusting a strap which has compact dimensions, and therefore limited weight, and at the same times allows effective fastening and adjustment of the strap to be achieved, reducing the possibility of accidental unfastening and release of the strap.

Moreover, an object of the present invention is to provide a device for fastening and adjusting the strap which is simple to produce and use, without decreasing the efficacy of fastening and the possibility of adjusting the length of the strap.

These and other objects are achieved by the device for fastening and adjusting a strap according to the present invention, comprising a base body, or casing, structured to allow insertion of at least part of the strap, and at least one ratchet constrained in a rotatable manner to the base body and provided with a coupling portion adapted to engage at least one corresponding portion of the strap. The device also comprises first elastic means interposed between the ratchet and the base body to reversibly retain the ratchet in at least one position of engagement with the strap, and at least one operating lever to rotate the ratchet from the at least one position of engagement with the strap to at least one position of disengagement therefrom, reversibly overcoming the opposition of the first elastic means.

The device is characterized in that the operating lever is constrained to the ratchet in a rotatable manner for at least a given angular interval.

The present device also comprises second elastic means to regulate rotation of the operating lever relative to the ratchet in said angular interval of rotation.

Said second elastic means to regulate rotation of the operating lever relative to the ratchet, in the undeformed, or starting, condition thereof, are such as to maintain the operating lever in at least a resting position not coincident with the position of contact with the ratchet.

Advantageously, by constraining the operating lever directly to the ratchet, the total dimensions of the device can be reduced.

Moreover, this structure makes it no longer necessary to shape the engagement surface of the lever with the ratchet in a particular way, and does not require extremely limited tolerances for mounting the lever on the ratchet.

According to an aspect of the present device, the angular interval of rotation of the operating lever relative to the ratchet comprises at least a position of contact of the operating lever with the ratchet, wherein rotation of the operating lever relative to the ratchet is prevented. Preferably, the position of contact between the operating lever and the ratchet is reached at least one end of the predetermined angular interval of rotation of the operating lever relative to the ratchet. In this way, the operating lever is rotatable relative to the ratchet for a given angular interval, without this entailing initial rotation of this latter relative to the base body. When the lever reaches the aforesaid position of contact with the ratchet, the further rotation of the operating lever causes integral rotation of the ratchet.

The need to rotate the operating lever relative to the ratchet, before coming into the position of contact with this latter to cause rotation thereof with respect to the base body of the device, allows the possibility of the occurrence of undesirable release of the ratchet to be decreased considerably.

In fact, in order to lift the ratchet and shift it to the position of disengagement from the strap, the lever must reach the aforesaid position of contact with the ratchet.

As stated, the device is also provided with first elastic means interposed between the ratchet and the base body to reversibly retain the ratchet in at least one position of engagement with the strap, which comprise at least one spring loaded in such a manner as to maintain the ratchet in the position of engagement with the strap, and also allow regulation of the rotation motion of the ratchet relative to the base body from the position of engagement with the strap to the position of disengagement therefrom.

As already stated, there are also provided second elastic means to regulate rotation of the operating lever relative to the ratchet in the angular interval of rotation, comprising a spring which is structured and preloaded in such a manner as to maintain the operating lever in at least one resting position, not coincident with the position of contact with the ratchet.

According to an aspect of the present invention, the preload of the spring required to regulate the rotation motion of the ratchet relative to the base body is greater than the maximum load of the spring necessary to regulate the rotation motion of the operating lever relative to the ratchet.

In other words, the characteristics of elastic response of the springs, respectively adapted to regulate the rotation motion of the ratchet relative to the base body and the rotation motion of the operating lever relative to the ratchet, are different. In particular, the load to apply to the spring to regulate the rotation motion of the ratchet relative to the base body is greater than the load to apply to the spring to regulate the rotation motion of the operating lever relative to the ratchet.

In this way, the operating lever is rotatable relative to the ratchet preventing rotation of this latter relative to the base body, until reaching the position of contact between the operating lever and the ratchet.

As a result of this arrangement, when the user wishes to unfasten the strap, causing release thereof from the device, he or she acts on the operating lever causing a rotation thereof relative to the ratchet.

Due to the greater preload of the spring acting on the ratchet, during rotation of the operating lever relative to the ratchet, the ratchet does not rotate relative to the base body of the device, remaining in the position of engagement with the strap.

Only after the operating lever has reached the position of contact with the ratchet, this latter is placed in contact with the operating lever, which causes rotation thereof relative to the base body, leaving the position of engagement with the strap, which can thus be removed freely from the device.

BRIEF DESCRIPTION OF THE DRAWINGS

There will now be described, purely by way of non-limiting example, some preferred embodiments of the present invention, with reference to the accompanying figures, wherein.

DETAILED DESCRIPTION OF THE INVENTION

With reference to the accompanying figures, there will now be described a preferred embodiment of the device 1 for fastening and adjusting a strap 10, preferably the chin strap used in safety helmets to secure the helmet to the user's head.

As it is known, safety helmets, such as those used in the motorcycle and automobile sector, are generally formed of an outer shell, usually made of polycarbonate or other thermoplastic resins or composite materials, inserted inside which is a layer of shock absorbing material (for example EPS), capable of protecting the user's head in the event of falls and, in general, in the event of impact with surfaces, objects, etc.

Below the layer of shock absorbing material, also called protective liner, there is generally a "comfort" liner, also called cap or internal padding, which prevents direct contact between the user's head and the protective layer, and therefore the shock absorbing material.

Figure 1:
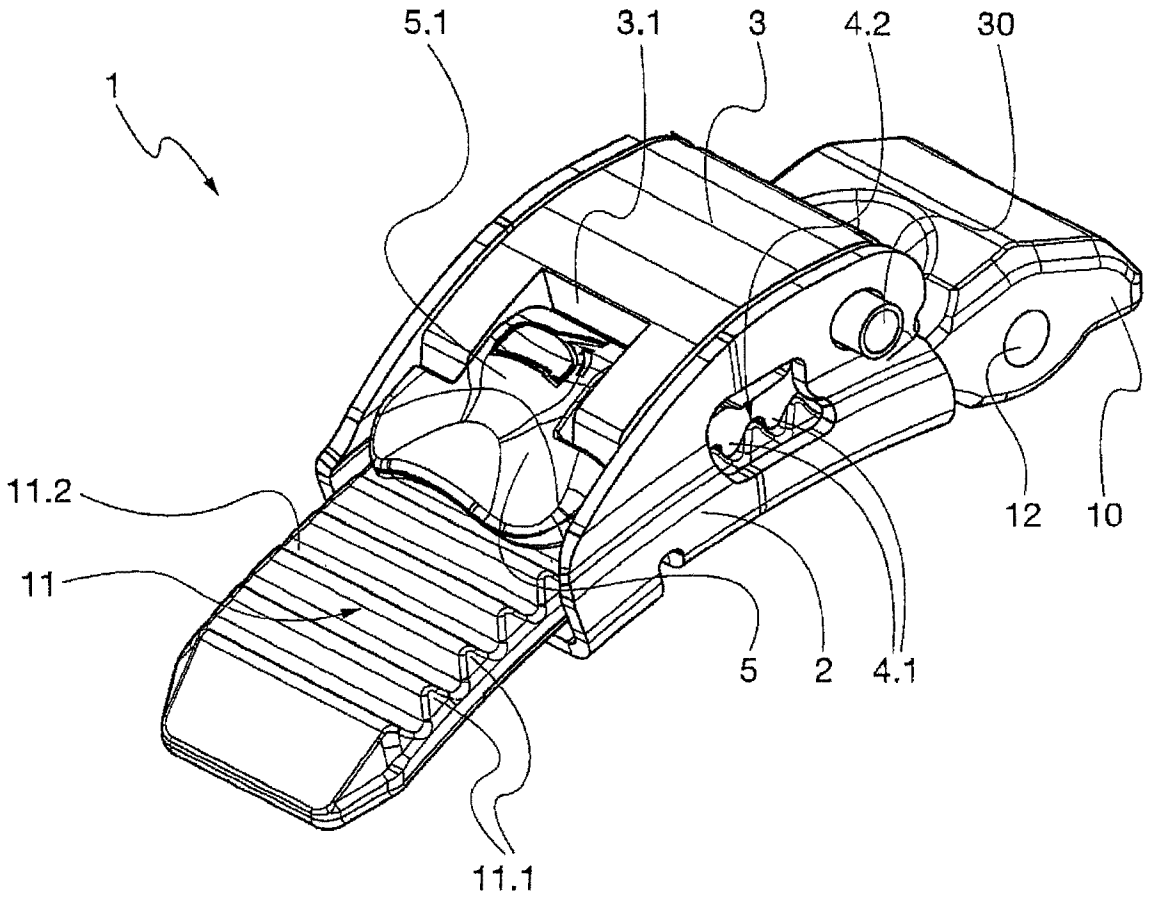
FIG. 1 is a perspective view of the device according to the present invention with the strap fastened therein.

As can be seen in the perspective view of FIG. 1, the device 1 for adjusting and fastening a strap 10 according to the present invention comprises a base body 2 structured to allow insertion of at least part of the strap 10, and at least one ratchet 3 constrained in a rotatable manner to the base body 2 and provided with a coupling portion 4 adapted to engage at least one corresponding portion 11 of the strap 10.

Figure 7:
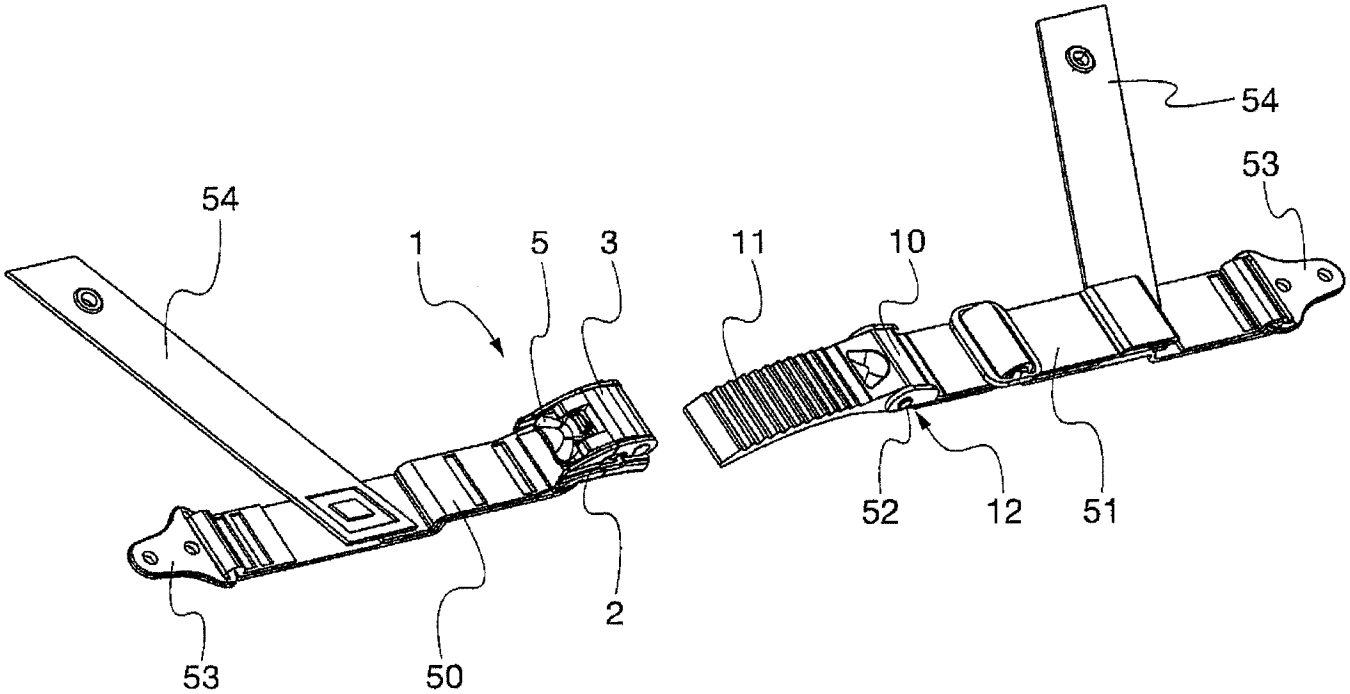
FIG. 7 shows the device according to the present invention provided with ribbon-like portions which allow constraining thereof to the shell of the helmet.

As can be seen in FIG. 7, the device is preferably used to fasten and adjust the chin strap, which is generally formed of two ribbon-like parts 50 and 51 constrained to the lateral portions and optionally also to the lower back portions of the helmet, and which are joined and mutually fastened by means of the device 1. The two portions of the strap mutually constrained by means of the device 1 can also be adjusted in length to allow adaptation to different users. The device is usually constrained to one of the two ends of the strap which assumes a ribbon-like shape.

It must be noted as of now that the accompanying FIGS. 1-6 show only a part of the strap 10, constrained to the ribbon-like portion 51, which is fastened and adjusted by means of the device 1 and which is inserted inside the device and destined to come into contact with the coupling portion 4 of the ratchet 3. FIG. 7 also shows the second ribbon-like portion 50 of the chin strap which is constrained to the body 2 of the device according to the present invention.

In fact, the strap 10 is provided with a portion 11 adapted to assume a position of engagement with the corresponding coupling portion 4 of the ratchet 3, in such a manner as to cause fastening inside the device.

The strap 10 is also provided with means which allow constraining thereof to the ribbon-like portion 51, and therefore to the helmet, for example by means of a suitable bracket 52, into which it is possible to insert the ribbon-like part 51, connected to this strap 10 by means of a rivet (or other similar known means) passing through a hole 12 produced therein.

The ribbon-like portion 51 is constrained to the shell of the helmet by known means, such as rivets passing through holes provided in the connection plate 53, and in an optional pull tab 54.

Naturally, other forms of connection between the strap 10 of the device and a portion of the chin strap, known in the art, can be used.

Figure 2:
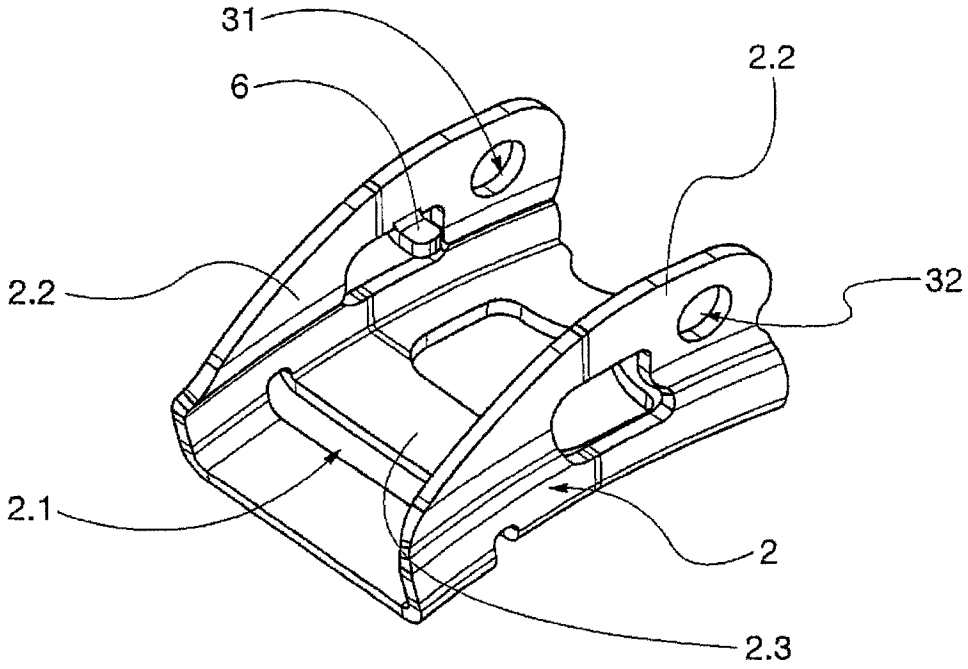
FIG. 2 is a perspective view of the base body of the device according to the present invention.
Figure 6:
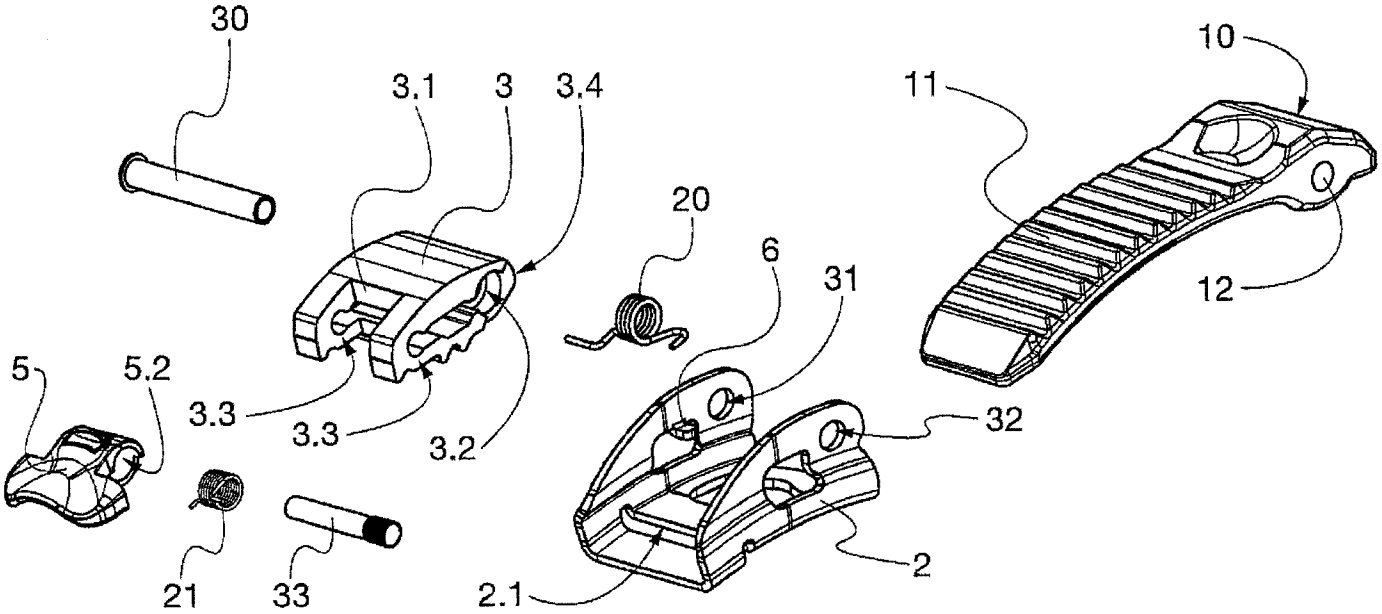
FIG. 6 is an exploded view of the device according to the present invention.

As can be seen in the embodiment shown in FIGS. 2 and 6, the base body 2 comprises an opening 2.1 in the lower surface 2.3 thereof, which allow the device to be constrained to the helmet, for example by means of another end of the chin strap which is constrained to the helmet. In particular, the opening 2.1 allows securing to the base body 2 of the device of a ribbon-like part 50 of the strap, shown in FIG. 7, which is in turn secured to the shell of the helmet by known means, such as rivets passing through holes provided in the connecting plate 53, and in an optional pull tab 54 to the opposite lateral part of the shell of the helmet relative to the part to which the ribbon-like portion 51 of the strap, to which the portion 11 destined to be inserted inside the device 1 is connected, is constrained.

Naturally, other forms of connection between the base body 2 of the device and a portion of the chin strap, known in the art, can be used.

It must be noted that the term coupling portion 4 of the ratchet 3 is intended as any means capable of allowing insertion of the strap inside the device and of causing fastening thereof inside this device in at least one position of engagement therewith, and which is at the same time capable of preventing extraction of the strap from the device without the ratchet 3 being shifted to at least one position of disengagement from the strap 10.

In the embodiment shown in the accompanying figures, the coupling portion 4 of the ratchet 3 comprises a toothed portion destined to engage the portion 11 of the strap, which also comprises at least one toothed portion.

It must be noted as of now that the term toothed portion is intended as at least one portion of the strap provided with at least one projecting tooth and/or at least one recess adapted to cooperate respectively with at least one recess and/or at least one tooth arranged on the toothed surface of the ratchet, in such a manner as to reach the position of engagement therebetween.

More in detail, the ratchet 3 comprises a coupling portion 4 having at least one tooth 4.1 and/or at least one recess 4.2 adapted to cooperate respectively with at least one recess 11.2 and/or at least one tooth 11.1 of the toothed portion 11 of the strap 10. In this way, the ratchet 3 can engage the toothed portion 11 of the strap 10 and prevent removal thereof.

In the embodiment shown in the accompanying figures, the ratchet 3 is provided in the lower part thereof with a toothed portion 4 having two teeth 4.1 with a recess 4.2 therebetween.

The toothed portion 11 of the strap 10 is instead provided with a plurality of teeth 11.1 spaced apart from one another by a recess 11.2.

Although specific reference has been made to this embodiment, in which the coupling portion 4 of the ratchet comprises a toothed portion adapted to engage the corresponding portion 11 of the strap 10, also toothed, it is possible to provide other methods of fastening the strap through reaching the position of engagement with the coupling portion 4 of the ratchet.

For example, the coupling portion 4 of the ratchet 3 can be structured in such a manner as to exert a pressure on the corresponding portion 11 of the strap 10, thus preventing sliding thereof inside the base body of the device, to prevent unfastening and consequently preventing extraction thereof from the device 1.

Figure 3:
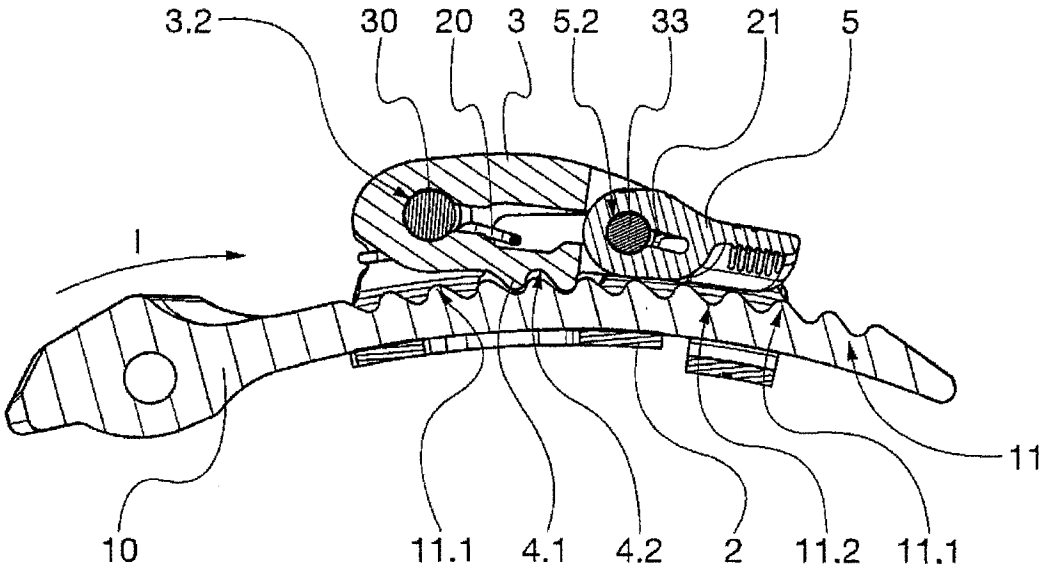
FIG. 3 is a sectional side view of the device according to FIG. 1.

As can be seen in the sectional side view of FIG. 3, in which the ratchet is in the position of engagement with the strap, the teeth 4.1 of the toothed portion 4 of the ratchet 3 are in the position of engagement with the toothed portion 11 of the strap 10 and in particular are partially inserted inside the recesses 11.2 that space the teeth 11.1 of the strap 10 apart.

On the other hand, the teeth 11.1 of the portion 11 of the strap 10 are at least partially inserted inside the recess 4.2 provided between the teeth 4.1 of the coupling portion 4 of the ratchet 3.

As shown in the accompanying figures, the teeth 4.1 and 11.1, belonging respectively to the toothed portions of the ratchet 3 and of the strap 11, each have an inclined surface and an orthogonal surface, in a "saw-toothed" configuration.

It must be noted that in the accompanying figures the teeth 4.1 and 11.1, respectively of the ratchet 3 and of the toothed portion 11 of the strap 10, do not have sharp edges but are produced with a substantially rounded profile, as described in the document EP-A-0772983, in order to facilitate sliding of the strap during its insertion inside the device.

When the strap 10 is inserted inside the body 2 of the device, it comes into contact with the inclined surfaces of the teeth 4.1 of the ratchet 3 and of the teeth 11.1 of the strap 10, in such a manner as to allow sliding at these inclined surfaces of the teeth 4.1 and 11.1. It is clear that extraction of the strap 10 from the base body 2 of the device is prevented due to contact between the orthogonal surfaces of the teeth 4.1 of the ratchet 3 and of the teeth 11.1 of the strap 10.

The device according to the present invention therefore allows fine adjustment (or micro-adjustment) of the length of the strap, due to the different positions of engagement that the toothed coupling portion 4 of the ratchet can reach with the plurality of teeth and/or recesses provided on the portion 11 of the strap 10.

In particular, it must be noted that the geometric structure of the section of the teeth, just as the pitch thereof, can naturally be modified according to constructional needs and taking into account that through these characteristics it is possible to carry out adjustment of the coupling between the strap and the ratchet and of the performance of the tensile strength of the device, i.e. the pull-out resistance of the strap from the device.

The ratchet 3 is constrained in a rotatable manner to the base body 2 of the device in such a manner as to be able to reach at least one position of engagement with the strap 10 and at least one position of disengagement therefrom. According to the embodiment shown in the accompanying figures, the ratchet 3 is pivoted on the base body 2 of the device by means of a pivot 30 passing inside the body of the appropriately shaped ratchet 3. The pivot 30 is constrained, by means of rivets, not shown, to the base body 2 of the device by means of two holes 31 and 32, provided thereon, arranged in opposed position on two lateral walls 2.2 of the base body 2. The pin 30 allows the ratchet 3 to be constrained in a rotatable manner to the base body 2. In other words, the ratchet 3 is rotatable about the axis constituted by the pivot 30 relative to the base body 2 of the device 1. As can be seen better in FIG. 5, the pivot 30 passes through the inside of the body of the ratchet 3 by means of a hole 3.2.

The device also comprises first elastic means 20 interposed between the ratchet 3 and the base body 2 to retain the ratchet 3 reversibly in at least one position of engagement with the strap 10, this position being shown in the sectional side view of FIG. 3.

Figure 5:
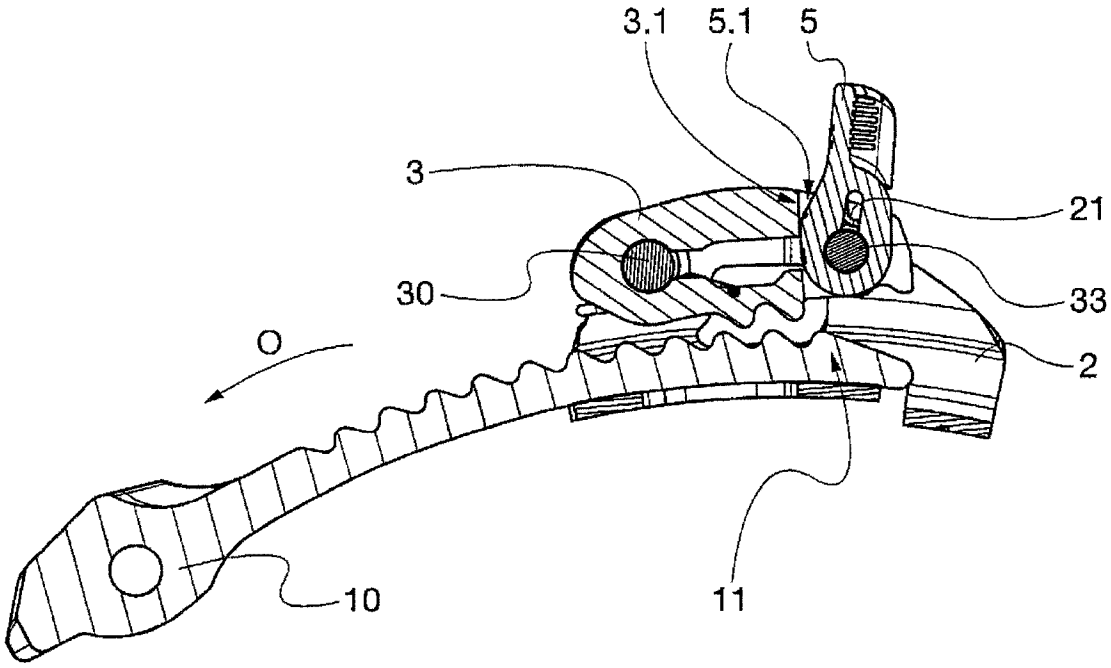
FIG. 5 is a sectional side view of the device according to the present invention with the ratchet in the position of disengagement from the strap.

These elastic means 20 also perform the function of regulating the rotation motion of the ratchet 3 relative to the base body 2 of the device, and in particular exert resistance to shifting of the ratchet 3 from the position of engagement with the strap 10 toward the position of disengagement therefrom (this latter position is shown in the sectional side view of FIG. 5).

According to a preferred embodiment of the present invention, the first elastic means 20 of the device comprise at least one spring, preloaded in such a manner as to maintain the ratchet 3 in the position of engagement with the strap 10, and to also allow regulation of the rotation motion of the ratchet 3 relative to the base body 2 from the position of engagement with the strap to the position of disengagement therefrom.

The device according to the present invention also comprises an operating lever 5 to rotate the ratchet 3 from the position of engagement with the strap 10 to at least one position of disengagement therefrom, reversibly overcoming the opposition of the first elastic means, and in particular of the spring 20 which regulates the rotation motion of the ratchet 3 relative to the base body 2.

The operating lever 5 is constrained to the ratchet 3 in a rotatable manner for at least a given angular interval.

Figure 4:
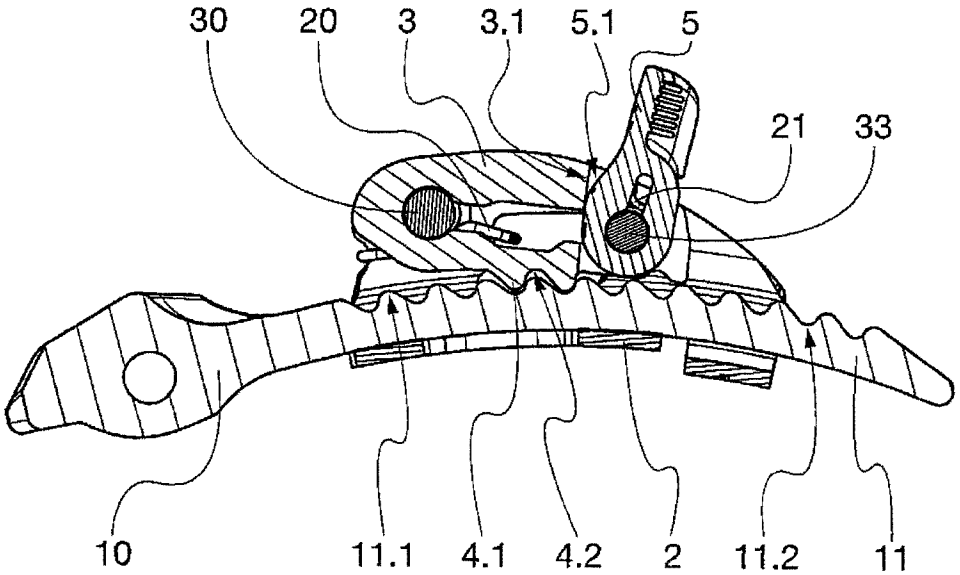
FIG. 4 is a sectional side view of the device according to the present invention with the operating lever in the position of contact with the ratchet.

In the embodiment shown in the figures, and as can be seen in particular in the sectional view of FIGS. 3-5, the operating lever 5 is pivoted on the ratchet 3 by means of the pin 33 which passes through the inside of the lever 5, in a circular seat 5.2, and is constrained to specific seats 3.3, by means of knurling and interference, provided on this ratchet 3.

Rotation of the operating lever 5 takes place in an angular interval that comprises at least one position of contact between the operating lever 5 and the ratchet 3 in which rotation of the operating lever 5 relative to the ratchet 3 is prevented.

Preferably, as shown in the sectional side view of FIG. 4, the position of contact between the operating lever 5 and the ratchet 3 is reached at least one end of the predetermined angular interval of rotation of the operating lever 5 relative to the ratchet 3.

In the position of contact between the operating lever 5 and the ratchet 3, in the embodiment shown in the figures, the upper surface 5.1 of the operating lever 5 comes into contact with an internal transverse surface 3.1 provided on the ratchet 3. It is clear that, following contact of the upper surface 5.1 of the operating lever 5 with the internal transverse surface 3.1 of the ratchet 3, further rotation of the lever 4 relative to the ratchet 3 is prevented, and therefore the position of contact constitutes one end of the angular interval of rotation of the lever 5 relative to the ratchet 3.

Naturally, the position of contact between the lever 5 and the ratchet 3 can be reached in alternative ways to the one described above, although bearing in mind that in this position rotation of the operating lever 5 relative to the ratchet 3 must not be allowed.

The device according to a particular aspect of the present invention also comprises second elastic means 21 to regulate rotation of the operating lever 5 relative to the ratchet 3 in the angular interval of (free) rotation, comprising a spring 21 which is structured and loaded in such a manner as to regulate rotation of the operating lever 5 relative to the ratchet 3.

Preferably, in the undeformed condition thereof, the spring 21 is adapted to maintain the operating lever 5 in at least one resting position, not coincident with the position of contact with the ratchet 3.

The resting position of the operating lever 5, imparted by the preload of the spring 21, is shown in FIG. 3, and corresponds to the position in which the operating lever is in the lowered position, in such a manner that it does not project from the body 2 of the device.

In the embodiment shown, and as can be appreciated by comparing FIGS. 3 and 4, the angular interval of rotation of the operating lever 5 is between the position of contact of the lever 5 with the ratchet 3 and the resting position of this lever 5, in which it is lowered. This angular interval of rotation of the operating lever 5 relative to the ratchet 3 from the resting position to the position of contact with the ratchet has an amplitude preferably between 60° and 90°. Even more preferably this angle has an amplitude of around 85°.

After reaching the position of contact, the further rotation imparted by the user on the operating lever 5 causes integral rotation of the ratchet 3 relative to the base body 2 of the device.

Rotation of the ratchet 3 relative to the base body 2 in turn causes passage from the position of engagement with the strap 10, visible in FIG. 3, to the position of disengagement from the strap 10 (shown in FIG. 5), in which the coupling portion 4 of the ratchet 3 and the corresponding portion 11 of the strap 10 are not in contact and the strap 10 can therefore be freely extracted from the device, in the direction of the arrow O.

The first elastic means 20 which regulate the rotation motion of the ratchet 3 relative to the base body 2 of the device, exert greater resistance to rotation than the second elastic means 21 which regulate the rotation motion of the operating lever 5 relative to the ratchet 3.

In detail, the preload of the spring 20 necessary to regulate the rotation motion of the ratchet 3 relative to the base body 2 is greater than the maximum load of the spring 21 necessary to regulate the rotation motion of the operating lever 5 relative to the ratchet.

In other words, the characteristics of the elastic response of the springs 20, 21 respectively adapted to regulate the rotation motion of the ratchet 3 relative to the base body 2 and the rotation motion of the operating lever 5 relative to the ratchet 3, are different. In particular, the load to apply to the spring 20 to regulate the rotation motion of the ratchet 3 relative to the base body 2 is greater than the load to apply to the spring 21 to regulate the rotation motion of the operating lever 5 relative to the ratchet 3.

In this way, the operating lever 5 is rotatable relative to the ratchet 3 preventing rotation of this latter relative to the base body 2, until reaching the position of contact between the operating lever 5 and the ratchet 3.

Consequently, it is possible to prevent undesirable and accidental operation of the device due to this need to operate firstly the operating lever 5, which rotates about its pivot 33, initially freely relative to the ratchet 3, and only after reaching the position of contact between the operating lever 5 and the ratchet 3, causes disengagement from the strap 10 by means of integral rotation of the lever 5 and of the ratchet 3, about the pivot 30 of this latter, relative to the base body 2 of the device 1.

The base body 2 of the device according to the present invention is also provided with opposing means 6 to limit rotation of the ratchet 3 relative to the base body 2. According to the embodiment shown in the perspective view of FIG. 2, the opposing means 6 comprise a portion projecting internally from a lateral surface 2.2 of the base body 2.

The projecting portion 6 is housed in a corresponding seat produced on the external lateral surface of the ratchet 3.

When the strap 10 is not inserted inside the base body 2 of the device, the means 6 for opposing rotation of the ratchet 3 prevent the ratchet 3, and consequently the operating lever 5 constrained thereto, from rotating due to the spring 20 until contact with the internal base surface 2.3 of the body 2.

Moreover, the opposing means 6 make it possible to prevent excessive rotation of the ratchet 3 when wishing to extract the strap 10 from the device and the ratchet 3 is raised after contact with the operating lever 5 toward the position of disengagement from the strap 10, as shown in FIG. 5.

Excessive rotation of the ratchet 3 must be prevented as this could cause stressing of the spring 20, resulting in yield and/or subsequent failure thereof.

It must be noted that, according to a preferred embodiment, rotation of the ratchet 3 relative to the base body 2 from the position of engagement with the strap to the position of disengagement from the strap has an amplitude ranging from 5° to 15°. Preferably, this angle has an amplitude of around 11°.

Naturally, the angles of rotation of the operating lever 5 relative to the ratchet 3, and of this latter relative to the base body 2 of the device, can have a different amplitude than the one described herein, bearing in mind that these angles influence technical-functional characteristics of the device, such as the ease with which the strap is disengaged, also accidentally, and the tensile strength that can be obtained in fastening of the strap.

In general, the construction and the dimensions of the device are such as to ensure the ergonomics required to allow simple and efficacious manual operation thereof.

There will now be described the steps for use of the device for fastening and adjusting the chin strap of a safety helmet according to the present invention, with reference to the particular embodiment of the device for fastening and adjusting a strap 10 described above.

When the user wears a safety helmet, in particular for motorcycling, current regulations establish that the chin strap must be fastened and adjusted in length in such a manner that it adheres substantially to the throat or, in any case, to that part of the face below the user's chin.

The strap 10 is inserted inside the base body 2 of the device, as indicated by the arrow I in FIG. 3, and the coupling portion 4 of the ratchet 3 enters the position of engagement with the portion 11 of the strap 10.

In detail, in the embodiment shown in the figures, and in particular in the sectional side view of FIG. 3 which shows the ratchet in the position of engagement with the strap 10, the coupling portion 4 of the ratchet 3, which is toothed, cooperates with the corresponding portion 11 of the strap 10, also toothed.

As already stated above, the structure of the toothing of the ratchet 3 and of the strap 10 make it possible to prevent extraction of this latter from the base body of the device without the ratchet being raised causing it to reach at least one position of disengagement from the strap 10, as shown in FIG. 5.

It must be noted that the presence of the toothed portion both on the ratchet 3 and on the strap 10 allows fine adjustment of the length of the chin strap for the user. In fact, by inserting the strap inside the body of the device, the ratchet reaches different positions of engagement therewith, obtaining "micrometric" adjustment of the length.

As will be clear at this point of the description, insertion of the strap 10 inside the body 2 of the device and engagement in succession with teeth of the portion 11 of the strap is obtained by means of a temporary rotation of the ratchet 3 relative to the base body, around the pivot 30.

In other words, during insertion of the strap, the ratchet 3 is temporarily raised, overcoming the action of the spring 20 which tends to maintain the ratchet 3 in the lowered position engaged with the strap 10.

This operation causes the lever 6 to be driven without relative rotation between the operating lever 5 and the ratchet 3.

After adjusting the length of the strap by means of progressive insertion thereof inside the body of the device, the coupling portion 4 of the ratchet 3 is in the position of engagement with the portion 11 of the strap 10, as shown in FIG. 3. In this position, extraction of the strap is prevented by the ratchet, and in the specific case by the geometric structure of the teeth of the strap 10 and of the ratchet 3, and can only take place after the ratchet 3 has been raised until reaching its position of disengagement from the strap 10.

It must also be noted that, in this position, the device is particularly compact, due to the fact that the operating lever 5 is constrained directly on the ratchet 3. Moreover, it must be noted that the operating lever is maintained in the resting position by means of the action of the spring 21 which tends to maintain this operating lever 5 in the lowered position (as shown in FIG. 3), preventing the lever 5 from being accidentally operated.

Moreover, it must be noted that the body 2 of the device is appropriately shaped to facilitate insertion of the toothed portion 11 of the strap 10 therein. In particular, below the lateral walls 2.2, the body 2 of the device has, viewed in a cross section, an increase of the width thereof in such a manner as to form a sort of guide which facilitates insertion and extraction of the strap 10 inside and from the body 2 of the device.

Moreover, all the edges of the body 2, of the ratchet 3, of the operating lever 5 and in general all the components of the present device, are rounded to prevent accidental engagement with the user, and in particular with his or her clothing.

When the user wishes to unfasten the strap 10 and remove it from the device, he or she acts manually on the operating lever 5 causing rotation thereof relative to the ratchet 3, on which it is constrained, relative to the pivot 33 thereof. The user overcomes the preload of the spring 21 which would tend to maintain the lever 5 in the resting position. The operating lever 5 is rotated until reaching the position of contact with the ratchet 3, as shown in FIG. 4.

In this position, rotation of the operating lever 5 is prevented by contact of the upper surface 5.1 thereof with the internal transverse surface 3.1 of the ratchet 3.

It must be noted that the lower portion of the operating lever 5 is appropriately provided with raised portions, and/or wedge-shaped elements, or the like, in such a manner as to guarantee a firm grip for the user's fingers, preventing slipping during opening of the device, and therefore during rotation of the operating lever 5.

Moreover, the ratchet 3, which is generally made of aluminium, has two lateral notches 3,4, in the front portion thereof, visible in FIG. 6, which facilitate assembly of the ratchet 3 inside the base body 2 of the device, which would otherwise be complicated, given the presence of the opposing means 6 on the inner wall of the side of this base body 2.

As already stated, before reaching the position of contact, rotation of the operating lever 5 relative to the ratchet 3, imparted by the user, does not cause rotation of the ratchet 3 relative to the base body 2 of the device, as the preload of the spring 20 interposed between the ratchet and the base body 2, required to operate the ratchet 3, is greater than the maximum load of the spring 21 required to regulate the rotation motion of the operating lever 5 relative to the ratchet 3.

In other words, the elastic characteristics of the springs 20, 21 are such that the load to apply to the spring 20 to regulate the rotation motion of the ratchet 3 relative to the base body 2 is greater than the load to apply to the spring 21 to regulate the rotation motion of the operating lever 5 relative to the ratchet 3.

Consequently, only after reaching the position of contact between the operating lever 5 and the ratchet 3, as shown in FIG. 4, the user is able, continuing his or her rotation action on the lever 5, also to cause rotation of the ratchet 3 relative to the base body 2 of the device, about its pivot 30, thus causing shifting of this ratchet 3 from the position of engagement with the strap 10 (FIG. 3) to the position of disengagement therefrom, as shown in FIG. 5.

It is clear that in this position, the strap can be freely extracted from the device, in the direction indicated by the arrow O of FIG. 5, as the coupling portion 4 of the ratchet 3 is no longer engaged with the corresponding portion 11 of the strap 10.

The need to reach a position of contact between the operating lever 5 and the ratchet 3 allows the safety of the fastening device to be improved considerably. In fact, the possibility of accidentally rotating the ratchet 3, and consequently causing disengagement from the strap 10, are greatly reduced.

The invention claimed is:

1. A device for fastening and adjusting a strap of safety helmets, comprising:

a base body structured to allow insertion of at least part of the strap, a ratchet pivotable around a first pin, said first pin extends through the inside of said ratchet and constrains said ratchet to said base body, said ratchet being provided with at least one coupling portion adapted to engage at least one corresponding portion of said strap, and a first spring interposed between and connected to said ratchet and said base body to reversibly retain said ratchet in at least one position of engagement with said strap, an operating lever to rotate said ratchet from said at least one position of engagement with said strap to at least one position of disengagement from said strap, reversibly overcoming the opposition of said first spring, a second spring adapted to maintain said operating lever in at least one resting position not coincident with said position of contact with said ratchet, wherein said operating lever is constrained on said ratchet in a rotatable manner for at least one given angular interval, the operating lever being rotatable around a second pin different from said first pin, said second pin being constrained to seats provided on said ratchet, and wherein said second pin extends through the inside of said lever and constrains said lever to seats provided on said ratchet.

2. The device according to claim 1, wherein said angular interval of rotation of said operating lever relative to said ratchet comprises at least one position of contact of said operating lever with said ratchet, rotation of said operating lever relative to said ratchet being prevented in said contact position.

3. The device according to claim 2, wherein said at least one position of contact between said operating lever and said ratchet is reached at one or more ends of said predetermined angular interval of rotation of said operating lever relative to said ratchet.

4. The device according to claim 1, wherein said ratchet comprises at least one internal transverse surface which engages at least the upper surface of said operating lever in said position of contact of said angular interval of rotation of the operating lever relative to the ratchet.

5. The device according to claim 1, wherein said first spring is preloaded in such a manner as to maintain said ratchet in said position of engagement with said strap, rotation of said ratchet relative to said base body from said at least one position of engagement with said strap to said at least one position of disengagement of said strap being regulated by said first spring.

6. The device according to claim 1, wherein said second spring regulates rotation of said operating lever relative to said ratchet in said at least one angular interval of rotation.

7. The device according to claim 6, wherein said second spring comprises at least one spring.

8. The device according to claim 6, wherein an elastic characteristic of said first spring is different from an elastic characteristic of said second spring, in such a manner that the load to apply to said first spring is greater than a load to apply to said second spring.

9. The device according to claim 1, wherein said base body further comprises a projecting portion to limit rotation of said ratchet relative to said base body.

10. The device according to claim 1, wherein said angular interval of rotation of said operating lever with respect to said ratchet from said at least one resting position to said at least one position of contact with said ratchet, is comprised between 60° and 90°.

11. The device according to claim 1, wherein the rotation of said at least one ratchet relative to said base body from said at least one position of engagement with said strap to said at least one position of disengagement of said strap is comprised between 5° and 15°.

12. The device according to claim 1, wherein said at least one coupling portion of said ratchet is a toothed portion and in that said strap comprises at least one toothed portion adapted to engage with said toothed coupling portion of said ratchet.

13. The device according to claim 12, wherein said at least one toothed portion of said ratchet comprises at least one tooth or at least one recess adapted to engage at least one corresponding recess or at least one corresponding tooth produced on said at least one toothed portion of said strap.

14. The device according to claim 13, wherein said at least one tooth or at least one recess of said toothed portion of said ratchet and of said strap are structured in such a manner as to prevent extraction of said strap from said base body, when said ratchet is in said at least one position of engagement with said strap.

15. The device according to claim 1, wherein said strap is a chin strap.

16. A safety helmet comprising at least one chin strap and at least one device for fastening and adjusting said at least one chin strap according to claim 1.

17. The device according to claim 1, wherein said second pin is constrained by knurling and interference.

* * * * *